US006247732B1

(12) United States Patent
Alton

(10) Patent No.: US 6,247,732 B1
(45) Date of Patent: Jun. 19, 2001

(54) VEHICLE COMPARTMENT LATCH

(75) Inventor: Darrel M. Alton, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/370,230

(22) Filed: Aug. 9, 1999

(51) Int. Cl.[7] ..... E05C 3/06
(52) U.S. Cl. ..... 292/216; 292/DIG. 43
(58) Field of Search ..... 292/336.3, 216, 292/DIG. 43, DIG. 63, DIG. 65, 125, 225, 171

(56) References Cited

U.S. PATENT DOCUMENTS 530,144 * 12/1894 Wegmann ..... 292/171
932,232 * 8/1909 Adams ..... 292/116
1,526,887 * 2/1925 Meter ..... 292/225
1,637,910 * 8/1927 Morrision ..... 292/225
1,910,102 * 5/1933 Godfrey ..... 16/381
4,927,196 * 5/1990 Girard ..... 292/201
4,936,611 * 6/1990 Palvolgyi ..... 292/28
5,074,603 * 12/1991 Brackmann ..... 292/216
5,137,311 * 8/1992 Brackmann ..... 292/216
5,445,326 * 8/1995 Ferro ..... 292/336
5,642,636 * 7/1997 Mitsui ..... 70/237
5,906,123 * 5/1999 Spurr ..... 70/264

* cited by examiner

*Primary Examiner*—Gary W. Estremsky
(74) *Attorney, Agent, or Firm*—Charles E. Leahy

(57) ABSTRACT

A vehicle closure has a compartment latch and a handle for operating the compartment latch. The compartment latch includes a reset member that is automatically engaged to disable the compartment latch when the compartment latch is unlatched. The reset member must be reset manually to restore normal operation of the compartment latch. Manual resetting is difficult to avoid inadvertent operation by children.

9 Claims, 3 Drawing Sheets

VEHICLE COMPARTMENT LATCH

TECHNICAL FIELD

This invention relates to a vehicle compartment latch and more particularly to a vehicle compartment latch for latching a vehicle compartment closure, such as a trunk deck lid in the closed position to secure the vehicle compartment.

BACKGROUND OF THE INVENTION

Passenger vehicles are normally equipped with a rear vehicle compartment for storing a spare tire and transporting items such as groceries and luggage. The compartment, conventionally known as a trunk is closed by a deck lid that is hinged to the vehicle body and swings open to provide access to the compartment. The closure or deck lid is equipped with a compartment latch that cooperates with a striker attached to the vehicle body to latch the closure in the closed position automatically when the deck lid is closed.

In order to open the deck lid, the compartment latch is conventionally designed to be unlatched or opened from a position outside the compartment because the compartment is not designed to hold passengers.

SUMMARY OF THE INVENTION

The object of the invention is to provide a vehicle compartment latch that does not automatically latch when deck lid is closed against the striker.

Another object of the invention is to provide a vehicle compartment latch that can be unlatched from inside the compartment.

A feature of the invention is that the vehicle compartment latch is equipped with a safety device that disables the detent lever when the compartment latch is unlatched thus preventing an inadvertent automatic latching of the vehicle compartment latch when the deck lid is subsequently closed.

Another feature of the invention is that the vehicle compartment latch is equipped with a safety device that must be reset manually after the compartment latch is unlatched in order to arm the compartment latch for a subsequent latching operation.

Another feature of the invention is that the vehicle compartment latch is equipped with a safety device that is automatically engaged but difficult to disengage.

Still another feature of the invention is that the vehicle compartment latch is equipped with a safety device that disables the latch detent in response to an unlatching operation.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
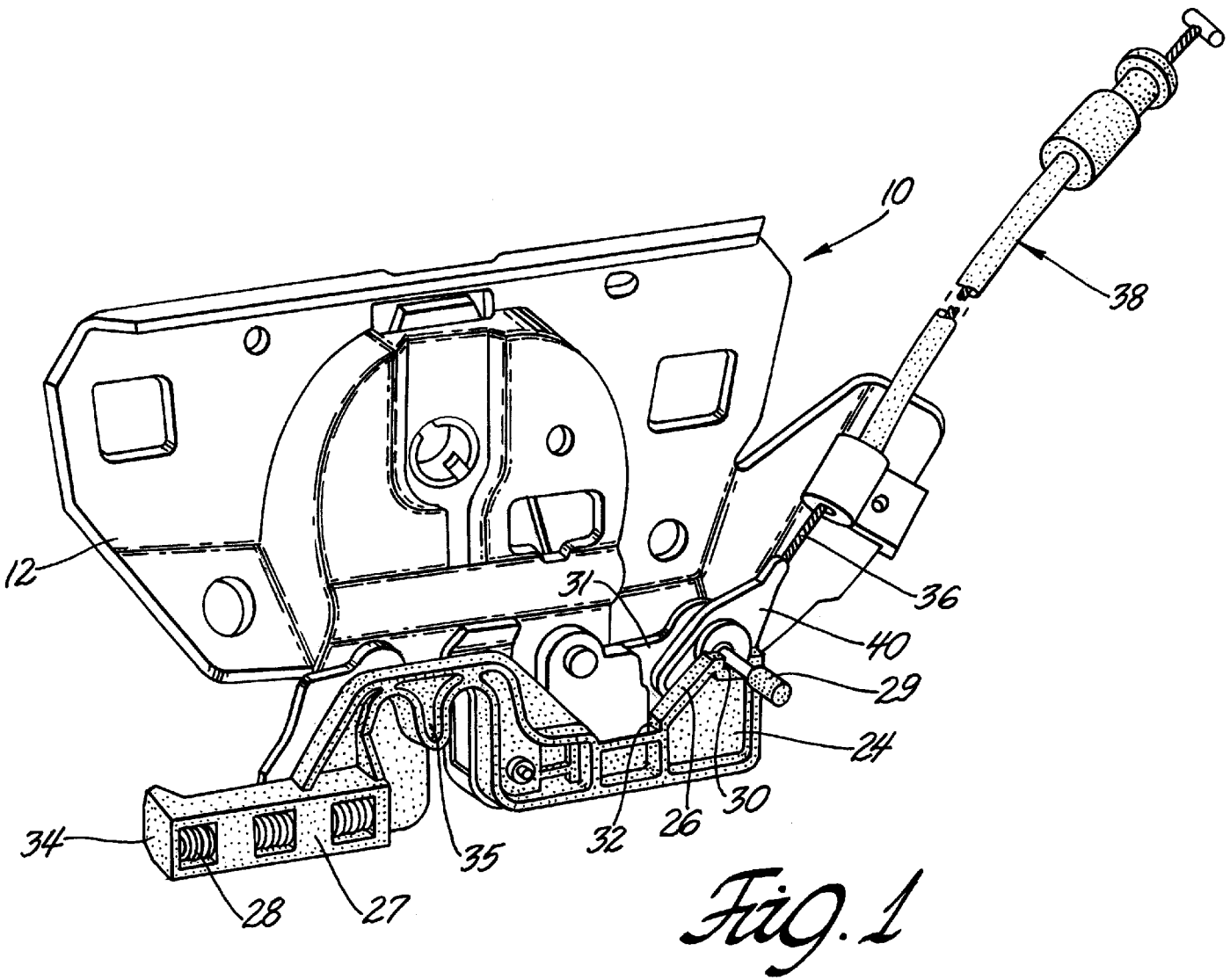
FIG. 1 is a perspective rear view of a vehicle compartment latch of the invention showing the parts of the vehicle compartment latch in the open or unlatched position with the reset member engaged.
Figure 2:
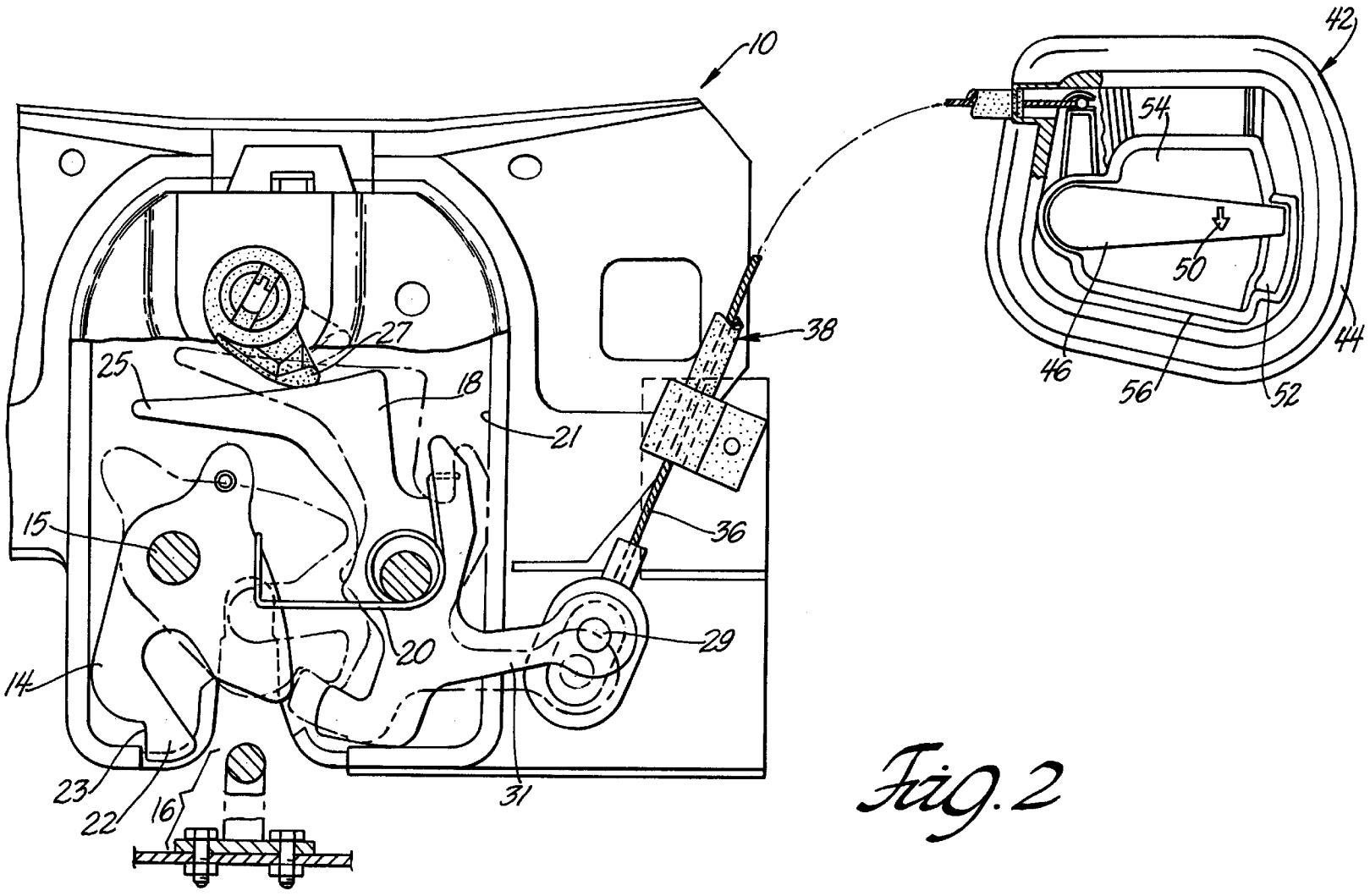
FIG. 2 is a rear view of a vehicle showing the vehicle compartment latch of FIG. 1 in section (with internal parts of the vehicle closure latch in the open or unlatched position in solid line and in the closed or latched position in dashed line) and a partially sectioned handle assembly for operating the compartment latch.

Vehicle compartment latch 10 comprises a housing or support 12 that is adapted for fastening to a vehicle compartment closure, such as a trunk compartment deck lid 1 1 and a fork bolt 14 that pivots on support 12 about pivot pin 15 between an open or unlatched position shown in solid line in FIG. 2 and a closed or latched position shown in dashed line in FIG. 2. Vehicle compartment latch 10 is attached to deck lid 11 so that fork bolt 14 is moved from the open position shown in FIG. 1 to the closed position shown in FIG. 2 when deck lid 11 is closed and fork bolt 14 engages a striker 16 that is attached to the vehicle body 17 at the deck lid opening. The cooperation of a fork bolt and striker is well known and need not be described in detail.

Vehicle compartment latch 10 further comprises a detent lever 18 that pivots on support 12 about pivot pin 19 and cooperates with fork bolt 14 in a well known manner to retain fork bolt 14 in the closed position shown in dashed line in FIG. 2 or release the fork bolt 14 for return to the open position shown in solid line in FIG. 2. That is, detent lever 18 pivots between a detent position shown in dashed line in FIG. 2 and a release position shown in solid line in FIG. 2. Fork bolt 14 is spring biased clockwise to the open position shown in solid line in FIG. 2 by a coil spring 20 that surrounds pivot pin 19 with an extension at one end engaging fork bolt 14. An extension at the other end of coil spring 20 engages detent lever 18 so that detent lever 18 is also spring biased counterclockwise by coil spring 20 against abutment 21 of support 12 to the detent position shown in dashed line in FIG. 2. Thus detent lever 18 rides over end 22 of fork bolt 14 and engages latch shoulder 23 of fork bolt 14 when fork bolt 14 is moved to the closed position by closing deck lid 11.

Detent lever 18 has an upper arm 25 and a catch 29 attached to a lower arm 31. Arm 25 cooperates with a rotary cam 27 that is operated by a conventional key lock cylinder (not shown) to move detent lever 18 to the release position allowing the deck lid 11 to open. Catch 29 is also used to move detent lever 18 to the release position as explained below.

Vehicle compartment latch 10 further comprises a safety reset member 24 that is attached to support 12 by pins disposed in slots of support 12 (not shown) so that reset member 24 translates back and forth on support 12 in a horizontal direction as best shown in FIGS. 1, 3, 4 and 5.

Figure 3:
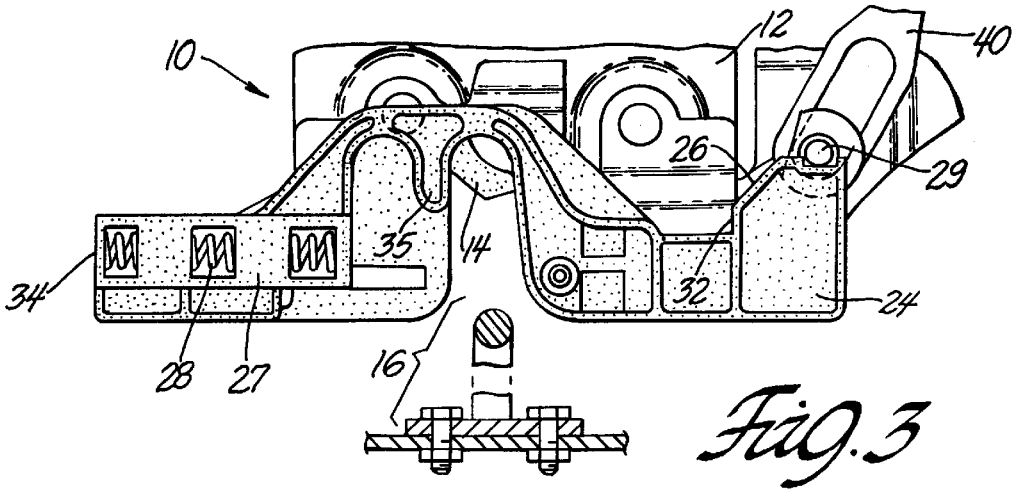
FIG. 3 is a rear view of the vehicle compartment latch shown in FIG. 1 showing the vehicle compartment latch in the open or unlatched position with the reset member engaged.

Reset member 24 has a cage 27 that houses a coil spring 28 that engages an inner end surface of cage 27 at the left end and an attachment of support 12, at the right end. Thus, coil spring 28 biases reset member lever 24 toward the engaged position, i.e. to the left with respect to support 12 as viewed in FIGS. 3, 4 and 5, where ramp 26 lifts catch 29 attached to arm 31 of detent lever 18 as shown in FIGS. 1, 2 and 3. Reset member 24 has a detent 30 at the lower end of ramp 26 and a detent 32 at the upper end of ramp 26 to hold catch 29 in the lower reset or cocked position shown in FIG. 4 or in the upper engaged position shown in FIG. 3. When lifted to the upper engaged position, catch 29 pivots detent lever 18 counterclockwise to the release position shown in solid line in FIG. 2.

Reset member 24 further includes a thumb pad 34 and a reset arm 35 that cooperates with striker 16 when deck lid 11 is closed and reset member 24 is cocked as explained below.

Catch 29 is attached to core wire 36 of a conventional pull cable 38 by a slotted cleat 40 at one end. Cleat 40 is slotted to provide a lost motion connection so that detent lever 18 and catch 20 can be cycled without moving core wire 36. Core wire 36 is attached to a handle assembly 42 at the opposite end so that compartment latch 10 can be unlatched from inside the trunk. Handle assembly 42 comprises a housing 44 that is attached to the interior side of deck lid 11. A handle 46 is pivotally attached to the housing by a pin that extends through the housing and attaches handle 46 to a lever 48 inside housing 44. Core wire 38 is attached to the end of lever 48. A coil spring inside housing 44 biases handle 46 and lever 48 to the latch position shown in FIG. 2.

Figure 5:
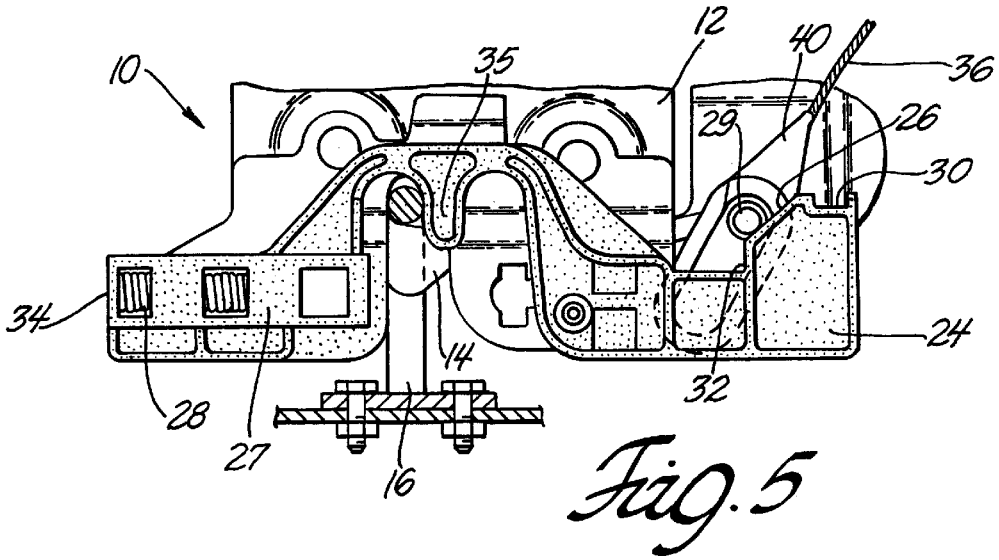
FIG. 5 is a rear view of the vehicle compartment latch shown in FIG. 1 showing the vehicle compartment latch in the closed or latched position.

Vehicle compartment latch 10 operates in the following manner. When deck lid 11 is closed, fork bolt 14 engages striker 16 and fork bolt 14 is pivoted counterclockwise by the closing deck lid 11 from the open or unlatched position shown in solid line FIG. 2 to the closed or latched position shown in dashed line trapping striker 16 in the compartment latch 10 as shown in FIG. 5. As fork bolt 14 pivots to the closed position detent lever 18 normally rides over end 22 of fork bolt 14 and engages latch shoulder 23. However, when safety reset lever 24 is engaged as shown in FIG. 3, detent lever 18 is held in the release position shown in solid line in FIG. 2 and fork bolt 14 simply bypasses detent lever 18 so that the deck lid is not latched in the closed position. Thus whenever the deck lid 11 is closed with safety reset lever 24 engaged, deck lid 11 can be reopened from the interior of the trunk or other closure simply by lifting the deck lid.

In order to latch deck lid 11 in the closed position, the reset member 24 must be cocked or reset before the deck lid is closed. Reset member 24 is reset or cocked by moving reset member 24 manually to the cocked or reset position shown in FIG. 4, that is, to the right with respect to support 12 from the position shown in FIG. 3 to the position shown in FIG. 4.

Reset member 24 is difficult to reset purposely to avoid or at least hindering a resetting operation by children. To move reset member 24 to the right to the reset position of FIG. 4. The catch 29 must be lifted out of detent 30 while the thumb pad 34 is pushed to the left. A mature adult with large hands can grasp the catch 29 in the crook of the forefinger and lift the catch 29 while the thumb pad is pushed to the right by the thumb of the same hand. However, for a child, the resetting reset member 29 is at least a two hand operation. Moreover, the child must be able to figure out the requirement for simultaneous operation of the distinct catch and thumb pad.

Figure 4:
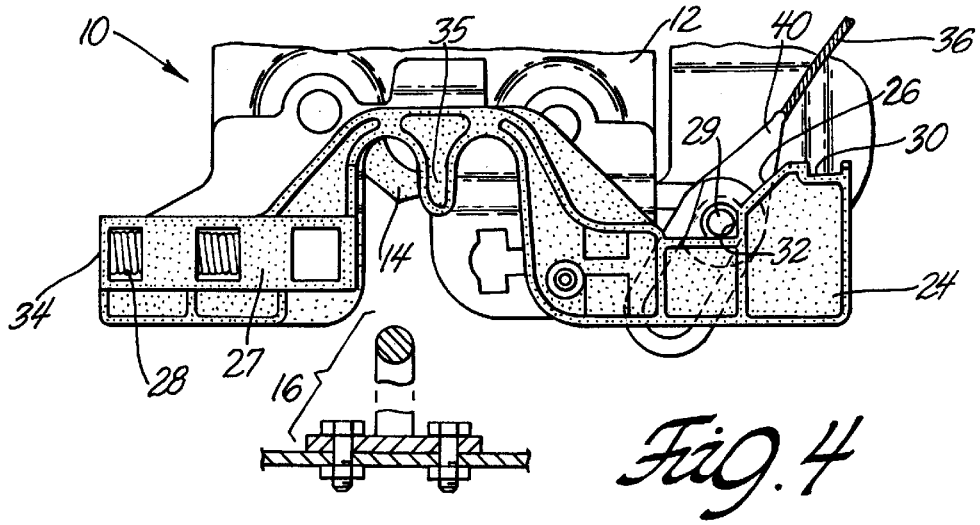
FIG. 4 is a rear view of the vehicle compartment latch shown in FIG. 1 showing the vehicle compartment latch in the open or unlatched position with the reset member reset or cocked.

As reset member 24 moves to the reset position of FIG. 4, catch 29 is moved down ramp 26 by return spring 20 pivoting detent lever 18 clockwise to the detent position shown in dashed line in FIG. 2. Coil spring 28 is simultaneously compressed in cage 27. When reset member 24 reaches the reset position, catch 29 engages detent 32 holding reset member 24 against the reaction of compressed coil spring 28. Detent lever 18 is now operational.

Thus when the deck lid 11 is subsequently closed, fork bolt 14 is pivoted to the closed position by striker 16 where fork bolt 14 is held in the closed position by detent lever 18 in a well known manner. The closed position of fork bolt 14 and the cooperating detent position of detent lever 20 are both shown in dashed lines in FIG. 2.

As fork bolt 14 is pivoted to the closed position, it engages and pivots detent lever 18 to the release position shown in solid line in FIG. 2 against the bias of return spring 20. This lifts catch 29 from lower detent 30 which allows reset member 24 to move toward the engaged position, that is toward the left as viewed in FIG. 5, under the action of coil spring 28. However, the travel of reset member 24 is cut short by reset stop arm 35 engaging striker 16 as shown in FIG. 5. This stops the travel of catch 29 up ramp 26 so that catch 29 does not engage detent 30. This allows detent lever 18 to move back to the detent position and hold fork bolt 14 in the latch position.

Vehicle compartment latch 10 is released by pivoting detent lever 18 counterclockwise to the release position shown in solid line in FIG. 2. Fork bolt 14 is now free to rotate clockwise and deck lid 11 is opened a given amount by the bias of the fork bolt return spring 20 and the pressure of the deck lid seal (not shown). These opening forces open deck lid 11 enough to withdraw striker 16 so that fork bolt 14 pivots clockwise back to the open position shown in solid line in FIG. 2 under the bias of the fork bolt return spring 20. As striker 16 is withdrawn, reset stop arm 35 is released and safety reset member 24 is automatically engaged by coil spring 28. The parts are now in the position shown in FIG. 3 so that the deck lid 11 cannot be latched in a closed position unless the reset member 24 is intentionally disengaged first.

In the event that the reset member 24 is disengaged and a child is then trapped in a latched trunk inadvertently, closure latch 10 can be unlatched by handle assembly 42. Handle assembly 42 is specifically designed for ease of operation and preferably colored to be noticed easily, for example a bright yellow handle 46 in a black housing. The bright yellow handle 46 also preferably includes a graphic black down arrow 50. Moreover the end of handle 46 is preferably disposed in a slot 52 so that the handle 46 can only be operated in the release direction. Housing 44 has finger space 54 above handle 46 and a thumb pad 48 below handle 46 so that handle 46 is easily engaged by four fingers and pulled down. When handle 46 is rotated down about 30°, detent lever 18 is rotated counterclockwise to the release position shown in solid line in FIG. 2. Deck lid 11 is now unlatched and opened easily.

While the compartment latch of our invention has been described in connection with deck lid 11, the compartment latch can be used with other compartment closures where unintentional latching is not desirable. In other words, many modifications and variations of the present invention in light of the above teachings may be made. It is, therefore, to be understood that, within the scope of the appended claims, the invention may be practiced otherwise than as specifically described.

What is claimed is:

1. A vehicle compartment latch comprising:

a support that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, and a reset member that moves between an engaged position and a reset position, the reset member holding the detent lever in the release position when in the engaged position and allowing the detent lever to return to the detent position when in the reset position, the reset member being slideable on the support member and biased toward the engaged position.

2. The vehicle compartment latch as defined in claim 1 wherein the reset member is moved to the engaged position when the compartment latch is unlatched and the reset member has a reset storm for engaging a striker to prevent the reset member from being moved to the engaged position when the compartment latch is latched by the striker.

3. The vehicle compartment latch as defined in claim 1 wherein the reset member has a ramp that is operatively associated with the detent lever.

4. A vehicle compartment latch comprising:

a support that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, a reset member that moves between an engaged position and a reset position, the reset member holding the detent lever in the release position when in the engaged position and allowing the detent lever to return to the detent position when in the reset position, and the reset member having a ramp that has a first detent at a lower end and a second detent at an upper end that are engaged by a catch attached to the detent lever to hold the detent in the release position and the detent position respectively.

5. The vehicle compartment latch as defined in claim 4 wherein the catch has a handle for lifting the catch out of the upper detent and the reset member has a thumb pad for pushing the reset member to the reset position when the catch is lifted out of the upper detent.

6. The vehicle compartment latch as defined in claim 4 further including a cable assembly having a core wire that is attached to the catch at one end for moving the detent lever from the detent position to the release position.

7. The vehicle compartment latch as defined in claim 6 wherein the core wire is attached to the catch by a lost motion cleat.

8. The vehicle compartment latch as defined in claim 6 further including a closure and a handle assembly, the support of the vehicle compartment latch and the handle assembly being attached to the closure and the core wire being attached to a moveable handle of the handle assembly at the opposite end.

9. The vehicle compartment latch as defined in claim 8 wherein the core wire is attached to the catch by a lost motion cleat.

* * * * *